United States Patent [19]

Rapp

[11] 4,403,370

[45] Sep. 13, 1983

[54] ARRANGEMENT FOR CLEANING BAND-LIKE DATA CARRIERS

[75] Inventor: Heinz Rapp, Munich, Fed. Rep. of Germany

[73] Assignee: AGFA-Gevaert AG, Leverkusen, Fed. Rep. of Germany

[21] Appl. No.: 295,093

[22] Filed: Aug. 21, 1981

[30] Foreign Application Priority Data

Sep. 4, 1980 [DE] Fed. Rep. of Germany ..... 3033315

[51] Int. Cl.[3] ..... A47L 9/28

[52] U.S. Cl. ..... 15/308; 15/326; 181/224; 181/225; 318/807

[58] Field of Search ..... 15/308, 326; 318/807; 181/224, 225

[56] References Cited

U.S. PATENT DOCUMENTS

| | | | |
|---|---|---|---|
| 2,853,147 | 9/1958 | D'Eustachio | 181/224 |
| 2,950,776 | 8/1960 | Stephens | 181/224 |
| 3,128,492 | 4/1964 | Hanscom et al. | 15/308 |
| 4,272,706 | 6/1981 | Somerville | 318/809 |
| 4,334,176 | 6/1982 | Baumgartner et al. | 318/102 |

*Primary Examiner*—Chris K. Moore

*Attorney, Agent, or Firm*—Michael J. Striker

[57] ABSTRACT

An arrangement for cleaning band-shaped data carriers, such as photographic film, has at least one brush element arranged to move relative to a data carrier so as to remove dust particles from the latter, an aspirating element for aspirating the thus removed particles, a high-frequency electric motor driving the aspirating means and having a frequency which is a multiple of the frequency of an electric network, and a frequency amplifier arranged to connect the electric motor with the electric network.

8 Claims, 2 Drawing Figures

ARRANGEMENT FOR CLEANING BAND-LIKE DATA CARRIERS

BACKGROUND OF THE INVENTION

The present invention relates to an arrangement for cleaning band-shaped data carriers, particularly photographic film.

Arrangements of this general type are known in the art. A known arrangement has a brush elements which moves relative to a data carrier so as to remove dirt particles therefrom, and an aspirating device for aspirating the thus removed particles. Such arrangements are utilized, for example, in photographic laboratories to remove dust particles from the film prior to its introduction into a copying machine. Such arrangements can also be found in the copying machines in the region of the copying station. One such arrangement is disclosed, for example, in the German Offenlegungsschrift No. 1,786,277. In this arrangement the cleaning brush is located in a housing which is connected by a conduit with an impeller arranged at a certain distance. This arrangement has the disadvantage that it is characterized by strong noise generation, on the one hand, and occupies a relatively large space, on the other hand.

SUMMARY OF THE INVENTION

Accordingly, it is an object of the present invention to provide an arrangement for cleaning band-shaped data carriers which avoids the disadvantages of the prior art.

More particularly, it is an object of the present invention to provide an arrangement for cleaning band-shaped data carriers which has a lower noise generation and occupies less space as compared with known arrangements of this type.

In keeping with these objects and with others which will become apparent hereinafter, one feature of the present invention resides, briefly stated, in an arrangement for cleaning band-shaped data carriers, which has at least one brush element arranged to move relative to a data carrier so as to remove dirt particles from the latter, and aspirating means for aspirating the thus removed particles, wherein the aspirating means is driven by a high-frequency electric motor having a frequency which is a multiple of the frequency of an electric network, and a frequency amplifier is provided for electrically connecting the electric motor with the electric network.

When the arrangement is designed in accordance with the present invention, it is very compact and can be easily transported as a table device. Such a device can be installed at any location; in other words, it can be arranged on the available machines on the head in a standing position, for example, to provide for film running without film deviation or turning.

The volume of the arrangement in accordance with the present invention is reduced to 10% as compared to the conventional arrangements. The noise generation is considerably reduced, inasmuch as a resonance phenomenon of the known 50 Hz machine is avoided, on the one hand, and the high-frequency noise of the motor in the housing of the device can be easily damped.

In accordance with another advantageous feature of the present invention, the electric motor is arranged in the center of an S-shaped curved tubular member so that the high-frequency sound waves are considerably damped by multiple reflection.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
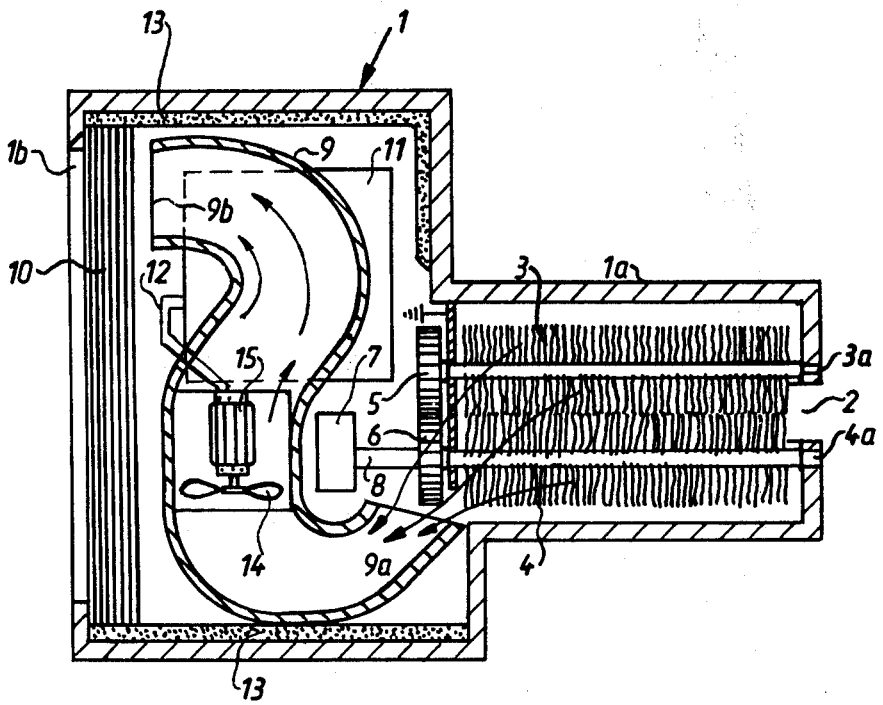
FIG. 1 of the drawing is a view showing an arrangement for cleaning band-shaped data carriers in accordance with the invention.

An arrangement for cleaning band-shaped data carriers, such as photographic films, has a housing which is identified by reference numeral 1. The housing 1 has a lateral extension 1*a* provided with a horizontal slot 2.

Two rotary brushes 3 and 4 are arranged in the extension 1*a* of the housing 1. More particularly, the rotary brushes 3 and 4 are so arranged that their contact faces are located in the region of the slot 2. The bristles of the rotary brushes 3 and 4 interengage with one another. The bristles of the rotary brushes 3 and 4 may be formed by synthetic plastic fibers or animal hairs, advantageously goat hairs. It is, however, preferable when the bristles are formed by conductive fibers, or conductive threads or strips provided between the non-conductive bristles. These light conductive members can be grounded via the shafts 3*a* and 4*a* of the rotary brushes.

The inner end portions of the shafts 3*a* and 4*a* of the rotary brushes 3 and 4 carry gears 5 and 6 which are in engagement with each other. One of the gears 5 and 6 (the gear 6 in the drawing) is connected with a shaft 8 of an electric motor 7. The electric motor 7 is a conventional synchronous motor with a network frequency of 50 Hz.

The interior of the housing 1 is substantially filled by a flexible hose or pipe 9. The pipe 9 has an end 9*a* which is arranged in the region of the inlet of the extension 1*a* of the housing and in the vicinity of the lower rotary brush 4 as shown in FIG. 1. The pipe 9 has another end 9*b* which faces toward the rear side of the arrangement, or in other words away from the extension 1*a* of the housing. The rear side of the housing is identified by reference numeral 1*b*, and a dust filter 10 is arranged prior to the opening of the rear side 1*b*. The above-mentioned other end 9*b* of the pipe 9 is actually directed to the dust filter 10.

The pipe 9 is curved in S-shaped manner. An axial impeller 14 and an electric motor 15 are arranged inside the pipe 9. More particularly, the axial impeller 14 and the motor 15 are located substantially in the center of the S-shaped pipe 9. The motor 15 is connected via conductors 12 with a network unit 11 with a frequency amplifier. The electric motor 15 is a high-frequency motor with a frequency of between 300 and 400 Hz, and an rpm of between 15000 and 23000.

The housing 1 has an inner side which is coated with a noise-damping element 13.

The operation of the arrangement takes place in the following manner.

A film is transported by a not shown transporting means between the rotary brushes 3 and 4. The rotary brushes 3 and 4 can be driven, in dependence upon the transport speed of the film, in or against the transport direction of the film. The brushes remove particles adhered to the film and guide them into a narrow space bounded by the wall of the extension 1*a* around the brushes 3 and 4. The impeller 14 which rotates with a very high rpm, for example 20000 rpm, provides such a strong suction force that the particles are aspirated into the pipe 9 and directed to the end 9*b* onto the dust filter 10. In accordance with the width of the brushes 3 and 4, the end portion 9*a* of the pipe 9 can be widened in the direction of elongation of the brushes. On the other hand, the end portion 9*a* of the pipe 9 can be split and directed into the chambers formed around the individual brushes in the housing portion 1*a*.

With the utilization of the above-mentioned fast-running impeller, which is also adjustable by the network unit 11 as to its running speed, the cleaning arrangement is provided with volume amounting to only more than 10% of the conventional cleaning arrangement. The double curvature of the pipe 9, in which the impeller is arranged in its center, provides for braking of high-energy sound waves without obstructing the air stream. Thereby the noise of the impeller and its motor is considerably damped. The easily exchangeable dust filter at the rear side of the arrangement also provides for an additional noise damping. Finally, the arrangement requires only one network connection which supplies the motor 7 for the rotary brushes as well as the network unit 11 for the impeller 14.

Figure 2:
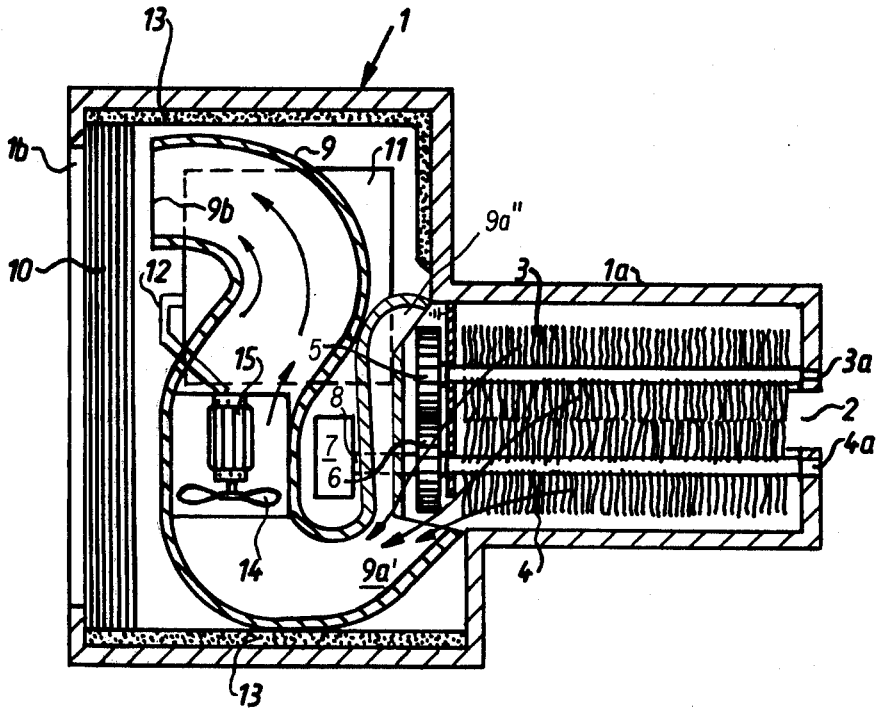
FIG. 2 is a view showing another embodiment of the invention arrangement.

In the embodiment shown in FIG. 2, the inlet end of the pipe 9 is subdivided into two sections 9*a*′ and 9*a*″ located in the vicinity of the lower rotary brush 4 and the upper rotary brush 3, respectively.

It will be understood that each of the elements described above, or two or more together, may also find a useful application in other types of constructions differing from the types described above.

While the invention has been illustrated and described as embodied in an apparatus for cleaning band-shaped data carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for cleaning band-shaped data carriers, particularly photographic films, comprising at least one brush element arranged to move relative to a data carrier so as to remove dirt particles from the latter; aspirating means for aspirating the thus removed particles; a high frequency electric motor driving said aspirating means and having a frequency which is a multiple of that of an electric network; a frequency amplifier arranged to connect said electric motor with the electric network; and an S-shaped tubular member having a central portion, said aspirating means and said high-frequency electric motor being located in said central portion of said S-shaped tubular member.

2. An arrangement as defined in claim 1; and further comprising a housing having an outlet and a portion surrounding said brush element, said S-shaped tubular member having a first end section located in the region of said housing portion surrounding said brush element, and a second end section located in the region of said outlet.

3. An arrangement as defined in claim 2; and further comprising an exchangeable dust filter arranged prior to said outlet of said housing as considered in direction of withdrawal of the dirt particles.

4. An arrangement as defined in claim 2, wherein said brush element includes two brush members, said housing portion forming two chambers each surrounding a respective one of said brush members, said first end section of said S-shaped tubular member being subdivided into two parts each leading into a respective one of said chambers of said housing portion.

5. An arrangement for cleaning band-shaped data carriers, particularly photographic films, comprising at least one brush element arranged to move relative to a data carrier so as to remove dirt particles from the latter; aspirating means for aspirating the thus removed particles; a high frequency electric motor driving said aspirating means and having a frequency which is a multiple of that of an electric network; a frequency amplifier arranged to connect said electric motor with the electric network; and a housing surrounding said high frequency electric motor, so that because of the provision of said high frequency electric motor making use of an electric motor with a frequency corresponding to that of the electric network unnecessary and also because of the location of said high-frequency electric motor in said housing, space consumption is reduced, noise generation is also reduced, and noise suppression is increased.

6. An arrangement as defined in claim 5, wherein said aspirating means includes an impeller connected with and driven in rotation by said electric motor.

7. An arrangement as defined in claim 5, wherein said frequency amplifier is arranged to provide for an adjustable frequency equal to between 300 and 400 Hz.

8. An arrangement as defined in claim 5, wherein said brush element has a plurality of bristle members which are electrically conductive and grounded.

* * * * *